US009421414B2

(12) United States Patent
Floyd

(10) Patent No.: US 9,421,414 B2
(45) Date of Patent: Aug. 23, 2016

(54) EXERCISE DEVICE

(75) Inventor: Lee Floyd, Draper, UT (US)

(73) Assignee: Lee Floyd, Draper, UT (US)

( * ) Notice: Subject to any disclaimer, the term of this patent is extended or adjusted under 35 U.S.C. 154(b) by 492 days.

(21) Appl. No.: 13/811,225

(22) PCT Filed: Jul. 20, 2011

(86) PCT No.: PCT/US2011/044751

§ 371 (c)(1),
(2), (4) Date: Mar. 28, 2013

(87) PCT Pub. No.: WO2012/012578

PCT Pub. Date: Jan. 26, 2012

(65) Prior Publication Data

US 2013/0203565 A1 Aug. 8, 2013

Related U.S. Application Data

(60) Provisional application No. 61/365,939, filed on Jul. 20, 2010.

(51) Int. Cl.

| | |
|---|---|
| ***A63B 21/00*** | (2006.01) |
| ***A63B 21/078*** | (2006.01) |
| *A63B 21/005* | (2006.01) |
| *A63B 21/02* | (2006.01) |
| *A63B 71/00* | (2006.01) |

(52) U.S. Cl.

CPC ..... *A63B 21/154* (2013.01); *A63B 21/0628* (2015.10); *A63B 21/078* (2013.01); *A63B 21/0783* (2015.10); *A63B 21/156* (2013.01); *A63B 21/4043* (2015.10); *A63B 21/005* (2013.01); *A63B 21/023* (2013.01); *A63B 71/0036* (2013.01)

(58) Field of Classification Search

CPC ..... A63B 21/00
USPC ..... 482/104, 106, 108, 100
See application file for complete search history.

(56) References Cited

U.S. PATENT DOCUMENTS

| | | | |
|---|---|---|---|
| 4,093,214 | A | 6/1978 | Coker et al. |
| 4,998,723 | A | 3/1991 | Santoro |
| 5,184,992 | A | 2/1993 | Banks |
| 6,537,182 | B2 | 3/2003 | Slawinski et al. |
| 6,552,737 | B1 | 4/2003 | Tanaka et al. |
| 6,592,498 | B1 | 7/2003 | Trainor |

(Continued)

*Primary Examiner* — Jerome W Donnelly
(74) *Attorney, Agent, or Firm* — Thorpe North & Western, LLP

(57) ABSTRACT

An exercise device (100) comprises a frame (120) and a resistance component (130) coupled to the frame (120). The exercise device (100) further comprises a cable (140) coupled to the resistance component (130) and supported by the frame (120), configured to transmit a force from a motion end (142) of the cable (140) to the resistance component (130). The exercise device (100) also comprises a pulley system (150) movably coupled to the frame (120) along a track (124), the pulley system (150) supporting the cable (140) as the cable (140) transmits the force to the resistance component (130), the pulley system (150) configured to be reversibly fixed in position relative to the frame (120). The pulley system (150) includes a first pulley member (152) and a second pulley member (156), the second pulley member (156) being removably attachable to the first pulley member (152) such that at least one of the first pulley member (152) and second pulley members (156) can be independently moved along the track (124).

11 Claims, 5 Drawing Sheets

(56) References Cited

U.S. PATENT DOCUMENTS

| | | | |
|---|---|---|---|
| 7,063,649 | B2 | 6/2006 | Szultka et al. |
| 7,094,185 | B2 | 8/2006 | Greenland |
| 7,374,515 | B2 | 5/2008 | Slawinski et al. |
| 7,666,124 | B2 | 2/2010 | Vaes |
| 7,739,604 | B1 | 6/2010 | Lyons et al. |
| 2005/0209070 | A1 | 9/2005 | Greenland |
| 2006/0206825 | A1 | 9/2006 | Dorn et al. |
| 2007/0042878 | A1 | 2/2007 | Lundquist et al. |
| 2007/0155596 | A1 | 7/2007 | Rogers et al. |
| 2007/0216700 | A1 | 9/2007 | Chen et al. |
| 2009/0204925 | A1 | 8/2009 | Bhat et al. |
| 2010/0085274 | A1 | 4/2010 | Kilpatrick, II et al. |

EXERCISE DEVICE

BACKGROUND

Exercise devices often include features that provide for a variety of exercises. One such feature utilizes a cable guided by pulleys that is attached to a resistance unit. To effectuate an exercise, a user can move an end of the cable. In some cases, the user can move the end of the cable in an unconstrained manner via a handle. Such exercises are typically known as cable exercises. In other cases, the end of the cable is attached to a component of the exercise device that is constrained to move in a predetermined manner, such as in a linear motion. Bench presses or squats are examples of exercises that typically utilize this type of feature.

To achieve a variety of exercises, the user can select from among several cables located about the exercise device. Typically, cable end locations have little or no adjustability. In other words, the exercise device cannot be adjusted to allow the cable end to "pull" from a different location. Furthermore, cable-type exercises and bench press type exercises often cannot be performed using the same cable. This can lead to a complicated arrangement of pulleys and cables in order to provide for a variety of exercises.

SUMMARY

Thus, there is a need for an exercise device capable of providing for a variety of exercises, having an adjustable cable pull location and using the same cable for both cable-type and bench press type exercises. Adjustability and customizability are frequently important factors for individuals who wish to focus exercises on specific muscle groups. Accordingly, an exercise device and associated methods are provided. Such a device can comprise a frame and a resistance component coupled to the frame. The exercise device can further comprise a cable coupled to the resistance component and supported by the frame, configured to transmit a force from a motion end of the cable to the resistance component. The exercise device can also comprise a pulley system movably coupled to the frame along a track, the pulley system supporting the cable as the cable transmits the force to the resistance component, the pulley system configured to be reversibly fixed in position relative to the frame. The pulley system can include a first pulley member and a second pulley member, the second pulley member being removably attachable to the first pulley member such that at least one of the first and second pulley members can be independently moved along the track.

Furthermore, a method of using an exercise device in accordance with the principles herein can comprise fixing a first pulley member of a pulley system to a frame of an exercise device, the pulley system being movably coupled to the frame along a track and configured to be reversibly fixed relative to the frame. The method can also comprise moving a second pulley member of the pulley system relative to the first pulley member, the second pulley member being removably attachable to the first pulley member, wherein a cable coupled to a resistance component is supported by the frame and the first pulley member, and a motion end of the cable is fixed relative to the second pulley member.

BRIEF DESCRIPTION OF THE DRAWINGS

FIG. 7 is a perspective view of a component of the safety mechanism in

FIG. 6.

Figure 1:
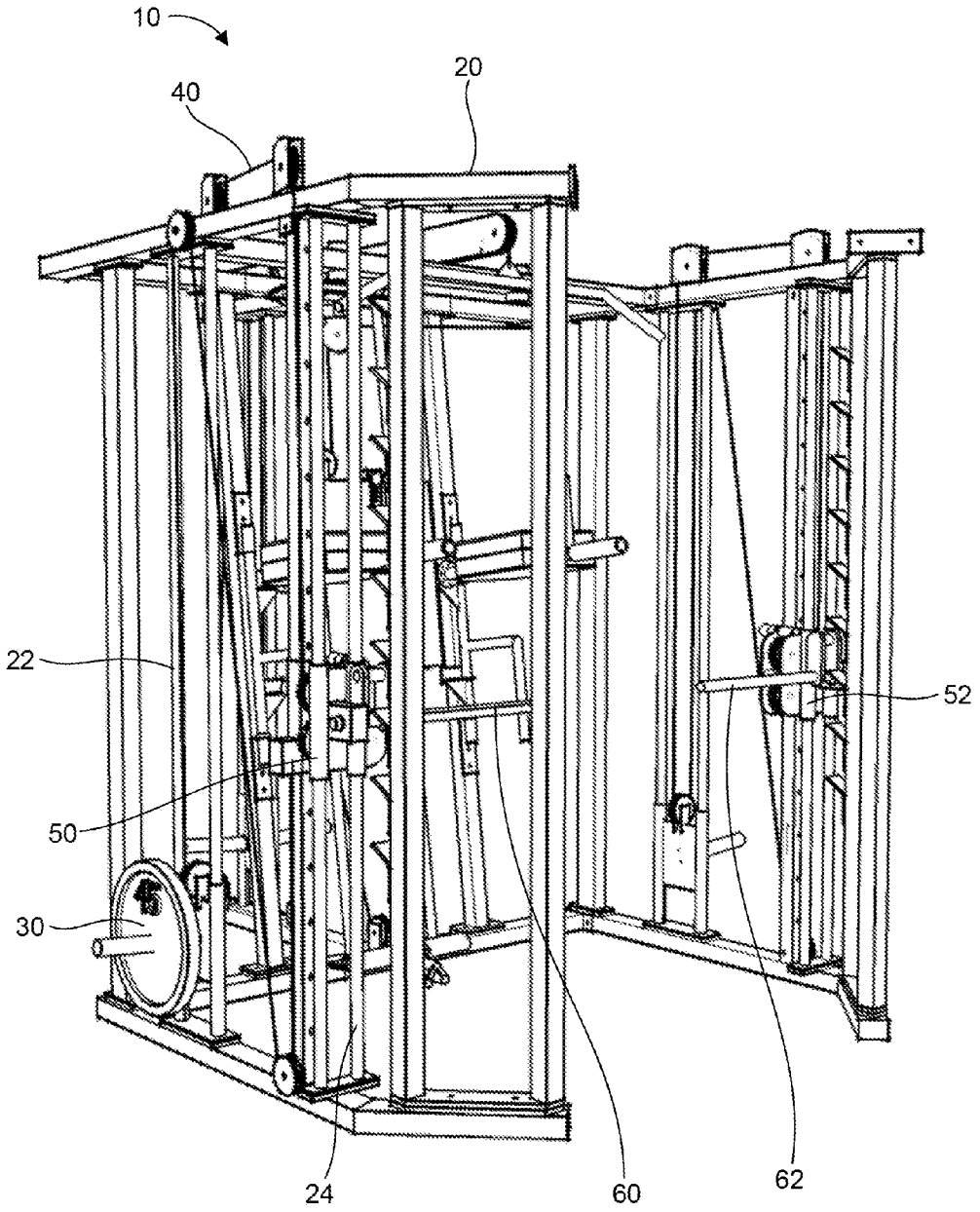
FIG. 1 is a perspective view of an exercise device, in accordance with an example of the present disclosure.

These figures are provided merely for convenience in describing specific embodiments of the invention. Alteration in dimension, materials, and the like, including substitution, elimination, or addition of components can also be made consistent with the following description and associated claims. Reference will now be made to the exemplary embodiments illustrated, and specific language will be used herein to describe the same. It will nevertheless be understood that no limitation of the scope of the invention is thereby intended.

DETAILED DESCRIPTION

Reference will now be made to certain examples, and specific language will be used herein to describe the same. Examples discussed herein set forth an exercise device and associated methods that can provide for a variety of exercises and have an adjustable cable pull location while using the same cable for both cable-type and bench press type exercises.

With the general embodiments set forth above, it is noted that when describing exercise device, or the related method, each of these descriptions are considered applicable to the other, whether or not they are explicitly discussed in the context of that embodiment. For example, in discussing the exercise device per se, the system and/or method embodiments are also included in such discussions, and vice versa.

It is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and "the" include plural referents unless the context clearly dictates otherwise. Thus, for example, reference to "a pulley" includes one or more of such pulleys and reference to "a track" includes one or more of such tracks.

Also, it is noted that various modifications and combinations can be derived from the present disclosure and illustrations, and as such, the following figures should not be considered limiting.

In describing and claiming the present invention, the following terminology will be used in accordance with the definitions set forth below.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Any steps recited in any method or process claims may be executed in any order and are not limited to the order presented in the claims unless otherwise stated. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Illustrated in FIG. 1 is an exercise device 10. In accordance with one example of the present disclosure, the exercise device 10 can comprise a frame 20, a resistance component 30, a cable 40, and a pulley system 50. The frame 20 can provide a general support and framework for various elements of the exercise device. For example, as illustrated in the figure, the frame 20 can include a plurality of elongate structural members arranged in a configuration that defines a workspace for a user of the exercise device 10. Thus, the frame 20 can be purpose built for the exercise device 10. In another example, the frame can include a preexisting structure that is adapted or incorporated for use as a frame of an exercise device, such as a wall or other structure of a building.

Additionally, the frame 20 can support the resistance component 30, the cable 40, and the pulley system 50. In certain examples, the frame 20 can include a seat, armrests, bars, handles, or other features that are configured to interface with a user. In still another example, the frame 20 can include a rack, bar, peg, or other feature configured to support weights or other elements of the resistance component. Such features can be utilized during an exercise or as storage features.

In one example, the resistance component 30 can be coupled to the frame 20. In a particular example, the frame 20 can include guides or tracks 22 configured to guide or constrain the motion of the resistance component 30 as it is moved during an exercise. The resistance component 30 can provide resistance with weights, magnetic resistance, flexible members such as rods, springs, or any other suitable resistance component. In addition, the frame 20 can include guides or tracks 24 configured to constrain the motion of the pulley system 50 for exercise set-up and/or during an exercise. Thus, the pulley system 50 can be movably coupled to the frame 20 along the track 24. In a particular example, the guides or tracks 22, 24 can be linear and can be oriented vertically, thus constraining movement to be in a linear up-and-down manner. Of course, the guides or tracks can alternatively be non-linear and can be oriented in any direction. Ergonomics, biomechanics, musculature, and characteristics of particular exercises may be considered when designing a guide or track and its shape and orientation.

As mentioned above, the frame 20 can support the cable 40. The cable 40 can be coupled to the resistance component 30 while supported by the frame 20. The cable 40 can be configured to transmit a force from a motion end of the cable to the resistance component 30. For example, the motion end of the cable can be configured to be located near a user during an exercise. The user can cause the motion end of the cable to move during the exercise, which transmits the force to the resistance unit 30, thus providing resistance for the exercise. In one embodiment, a handle can be attached, removably or permanently, to the motion end of the cable, thus facilitating the exercise. In another embodiment, the motion end can be coupled to the pulley system 50, discussed further below, to facilitate the exercise. In either case, the pulley system 50 can be configured to support the cable 40 as the cable transmits the force to the resistance component 30.

In a specific aspect, the exercise device 10 can include a pair of pulley systems 50, 52 aligned on tracks located on opposing sides of the frame 20. Each pulley system 50, 52 can be associated with a cable and resistance component, as discussed above. Furthermore, the pair of pulley systems 50, 52 can be configured to allow a user to be located between the pulley systems and to engage both of the pulley systems simultaneously while performing an exercise. Thus, the user can grasp handles 60, 62 attached to the pulley systems 50, 52 to perform, for example, a dead lift exercise. The handles 60, 62 can optionally extend such that the user can stand between ends of the handles in an open space between the handles, with a handle on either side of the user. This configuration can allow the user to lift the handles up adjacent to the hips, as opposed to lifting a single bar in front of the legs, to achieve a safer and more effective lifting posture. Of course, it should be recognized that a single handle or bar can be coupled to both pulley systems 50, 52. In another example, the user can grasp handles attached to the motion end of each cable. This configuration can allow the user to perform cable exercises, for example, by pulling the cables across the body toward opposite sides of the frame.

Figure 2:
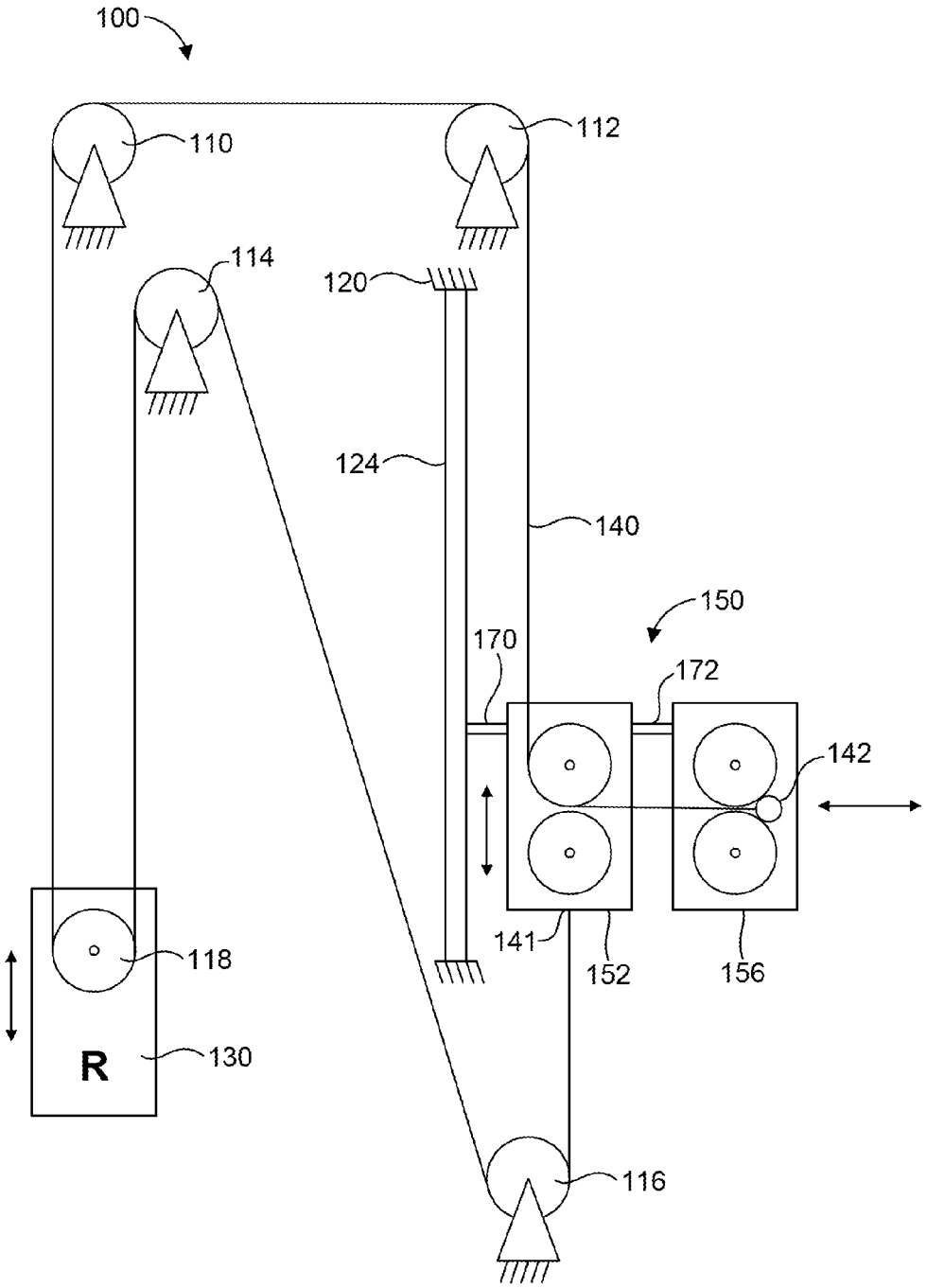
FIG. 2 is a schematic representation of an exercise device, in accordance with another example of the present disclosure.

Illustrated in FIG. 2 is a schematic representation of an exercise device 100, in accordance with the present disclosure. The exercise device 100 is similar to the exercise device 10 discussed above in many respects. For example, the exercise device 100 can include a frame 120, a resistance component 130, a cable 140, and a pulley system 150. The pulley system 150 can be movably coupled to the frame 120 along a track 124. The pulley system can support the cable 140 as the cable transmits force to the resistance component 130.

In one aspect, the exercise device 100 can include fixed pulleys 110, 112, 114, and 116 disposed about the frame 120 to direct the cable 140 as the cable transmits force between the pulley system 150 and the resistance component 130. Additionally, the exercise device 100 can include a pulley 118 coupled to the resistance component 130 to cause the resistance component to move in response to force applied to the resistance component from cable 140.

Furthermore, the pulley system 150 can include a first pulley member 152 and a second pulley member 156. The second pulley member 156 can be removably attached to the first pulley member 152 of the pulley system 150 with a removable coupling 172. In one aspect, a cable end 141 can be coupled to the pulley system 150. For example, the cable end 141 can be coupled to a first pulley member 152. In another aspect, a motion end 142 of the cable 140 can be coupled to a second pulley member 156 of the pulley system 150. Thus, in this configuration, movement of the entire pulley system 150, with no relative movement between the first pulley member 152 and the second pulley member 156, can allow the resistance component to remain substantially unaffected. In other words, movement of the pulley system 150, causing movement of the cable about pulley 118 coupled to the resistance component 130, imparts no substantial force to the resistance component, which allows the resistance component to remain substantially stationary. This can be beneficial when moving or repositioning the pulley system 150 when the first pulley member 152 and the second pulley member 156 are coupled to one another because substantially no resistance is offered by the resistance component. This can ease reconfiguration of the pulley system when changing exercises.

The pulley system 150 can be configured to be reversibly fixed in position relative to the frame 120. For example, the pulley system 150 can be moved along the track 124 during an exercise or fixed in a position for a certain exercise. Following the exercise, the pulley system 150 can be moved and fixed in another position for a different exercise. In this manner, the pulley system 150 can be fixed relative to the frame 120 but such fixture is not permanent, thus the pulley system 150 can be reversibly fixed in position. Accordingly, the figure illustrates a removable coupling 170 between the pulley system 150 and the track 124. Such a removable coupling can include a pin or latch connection. It should be noted that a removable coupling can optionally be between the pulley system 150 and the frame 120 to reversibly fix the position of the pulley system relative to the frame.

As mentioned above, the pulley system 150 can include a first pulley member 152 and a second pulley member 156. The second pulley member 156 can be removably attached to the first pulley member 152 of the pulley system 150 with a removable coupling 172, such as a pin or latch connection. With the pulley system 150 being movable relative to the frame 120 and with the second pulley member 156 and the first pulley member 152 being removably attachable to one another, at least one of the first pulley member 152 and second pulley member 156 can be independently moved along the track 124. It should be noted that for purposes of the schematic illustration of FIG. 2, either one or both of the first pulley member 152 and second pulley member 156 can be moved along the track 124 even though the second pulley member 156 is not shown adjacent to the track 124. Additionally, the track 124 can include a plurality of tracks or guides and the first and second pulley members can be operatively coupled to any or all of such tracks to be movable relative to the frame and/or one another.

In a particular aspect, the pulley system 150 can be reversibly fixed relative to the frame 120 by a connection 170, such as a pin or latch connection, between the first pulley member 152 and the frame 120. In other words, the first pulley member 152 can be configured to be movably coupled to a track 124 and reversibly fixed relative to the track. Additionally, the second pulley member 156 can be moved relative to the frame 120 and/or track 124. In another example, the second pulley member 156 can be removably attached to the first pulley member 152 and both the first and second pulley members can be moved relative to the frame 120 and/or track 124.

This characteristic of having the second pulley member 156 removably attachable to the first pulley member 152 can provide for a wide variety of exercises and uses for the exercise device 100 because the pulley system 150 can be moved to provide cable "pull" from a variety of locations. This is beneficial for both cable-type exercises and bench press type exercises.

Figure 3A:
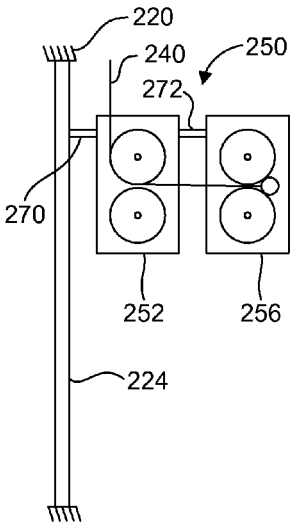
FIG. 3A illustrates a schematic representation of a first position of a pulley system of an exercise device in, accordance with an example of the present disclosure.
Figure 3B:
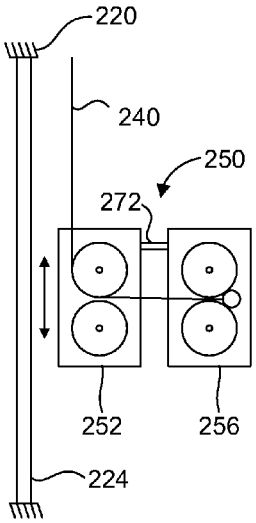
FIG. 3B illustrates a schematic representation of movement of a pulley system of an exercise device, in accordance with an example of the present disclosure.
Figure 3C:
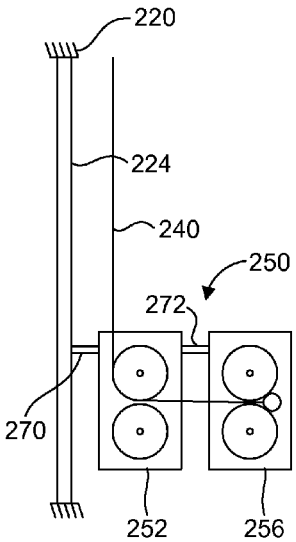
FIG. 3C illustrates a schematic representation of a second position of a pulley system of an exercise device, in accordance with an example of the present disclosure.

For example, as illustrated in FIGS. 3A-3C, to set up for a cable-type exercise and/or a bench press type exercise, the user can fix the pulley system 250 at a desired location relative to the frame 220. As shown in FIG. 3A, the pulley system 150 can be fixed at a first position relative to the track 124 and frame 220. Removable coupling 270 can be disengaged to allow the pulley system 250 to move relative to the track and frame, as shown in FIG. 3B. The removable coupling 270 can be reengaged to fix the pulley system 250 at a second position relative to the track and frame, as shown in FIG. 3C.

Figure 3D:
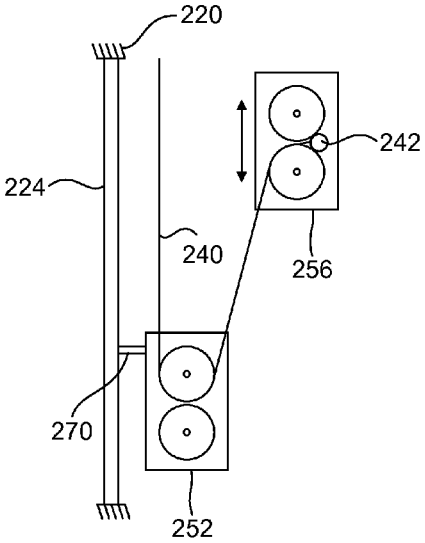
FIG. 3D illustrates a schematic representation of a fixed first pulley member and movement of a second pulley member of an exercise device, in accordance with an example of the present disclosure.

For a bench press type exercise, when positioning the pulley system 250, the first pulley member 252 can be positioned at or below the chest of the user. With the pulley system 250 at a desired location relative to the track and/or frame, for example as illustrated in FIG. 3C, the user can set up for a bench press type exercise. To do so, the user can disengage removable coupling 272 to allow the second pulley member 256 to be movable relative to the first pulley member 252, as shown in FIG. 3D. The motion end 242 of the cable is coupled to the second pulley member 256 such that the motion end 242 is fixed relative to the second pulley member 256. Additionally, a handle can be removably or permanently attached to the second pulley member 256 to facilitate the exercise. Thus, when the user pushes or pulls on the handle, the second pulley member 256 moves relative to the frame 220, moving the motion end 242 of the cable 240 and providing resistance for the exercise. The first pulley member 252 remains fixed relative to the frame 220 and supports the cable 240 during the exercise. Thus, the first pulley member 252 can be positioned at a starting/ending point for the movement of the exercise and the second pulley member 256, when moved away from the first pulley member 252, will be drawn toward the first pulley member 252 due to the force in the cable 240 provided by the resistance component.

It should be recognized that "pull down" type exercises can also be performed on the exercise device. In this case, the first pulley member 252 can be positioned sufficiently high relative to the user such that an effective pull down exercise can be performed when moving the second pulley member 256 relative to the frame 220 and first pulley member 252. Thus, set up for a pull down exercise is similar to set up for a bench press type exercise, except that the positioning of the first pulley member 252 for a pull down exercise may be higher than the position for a bench press type exercise. Additionally, movement of the second pulley member 256 relative to the first pulley member may be below the first pulley member 252 for a pull down type exercise as opposed to above the first pulley member 252 for a bench press type exercise. In another aspect, the fixed position of the first pulley member 252 can be such that the user can move the second pulley member 256 alternatively above and below the first pulley member 252 to achieve aspects of both bench press type exercises and pull down type exercises.

Figure 3E:
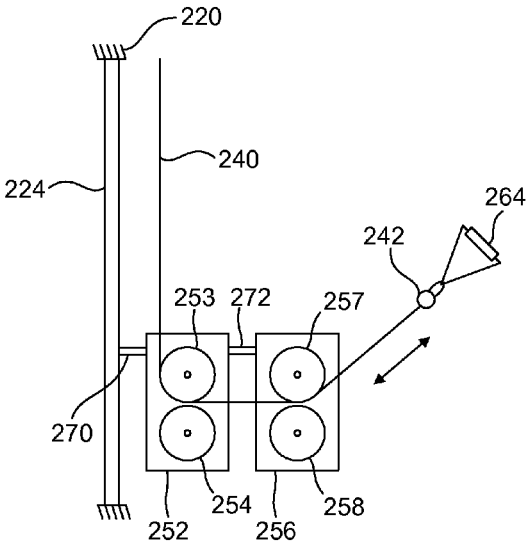
FIG. 3E illustrates a schematic representation of a fixed pulley system and movement of a motion end of a cable of an exercise device, in accordance with an example of the present disclosure.

When positioning the pulley system 250 for a cable-type exercise, the pulley system 250 can be positioned to provide an appropriate range of motion of the movable end 242 of the cable 240 as the user performs the exercise. In other words, the pulley system 250 can be positioned to provide a suitable range of force vectors provided by the cable 240 acting on the pulley system 250 throughout the movement of the cable exercise. With the pulley system 250 at a desired location relative to the track and/or frame, for example as illustrated in FIG. 3C, the user can proceed with a cable type exercise. To facilitate a cable type exercise, the motion end 242 of the cable 240 can be coupled to the second pulley member 256 such that the motion end 242 is movable relative to the second pulley member 256, as shown in FIG. 3E. Thus, when the user pulls on the cable 240, the first and second pulley members remain fixed relative to the frame 220 and the user can execute the cable exercise. Additionally, a handle 264 can be removably or permanently attached to the motion end 242 of the cable 240 to facilitate the exercise wherein the user pulls on the cable using the handle 264. In a particular aspect, the pulley system 250 can be fixed relative to the frame 220 because the first pulley member 252 is fixed relative to the frame 220 with removable coupling 270 and the second pulley member 256 is removably attached to the first pulley member 252 with removable coupling 272.

With continued reference to FIGS. 3A-3E, the first and second pulley members 252, 256 can include pulleys to support the cable 240 and provide for movement of the cable relative to the pulley members 252, 256. In certain embodiments, the first pulley member 252 and/or the second pulley member 256 can include a single pulley or a plurality of pulleys. For example, the first pulley member 252 can include pulleys 253, 254 and the second pulley member 256 can include pulleys 257, 258. In a particular embodiment, as illustrated, the motion end 242 of the cable 240 can be coupled to the second pulley member 256 having two pulleys 257, 258, wherein the motion end 242 of the cable has a stop feature 244, such as a ball, cone or other shape which does not fit through a space between pulleys 257, 258 and that prevents the motion end 242 of the cable from passing between the pulleys. In this manner, the motion end 242 of the cable can be coupled to the second pulley member 256 to allow the cable 240 to pass between the two pulleys 257, 258 when a user pulls on the cable, but the cable cannot move back through the two pulleys 257, 258 beyond the stop feature 244. The stop feature 244 can also cause the motion end of the cable to move with the second pulley member 256 when the second pulley member is moved, such as when the second pulley member is being moved during a bench press type exercise or pull down type exercise.

Figure 4A:
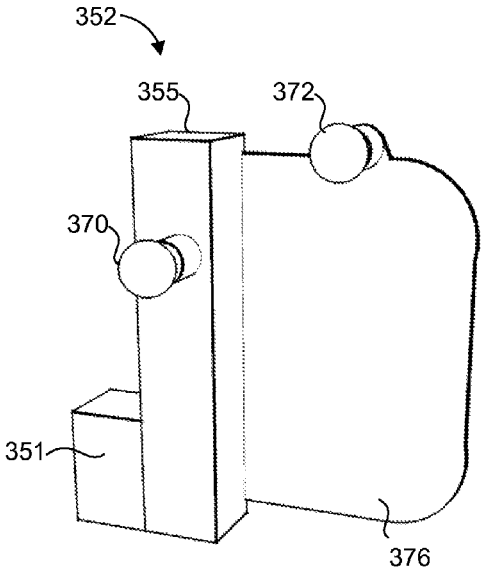
FIG. 4A is a side view of a first pulley member of a pulley system of an exercise device in, accordance with an example of the present disclosure.
Figure 4B:
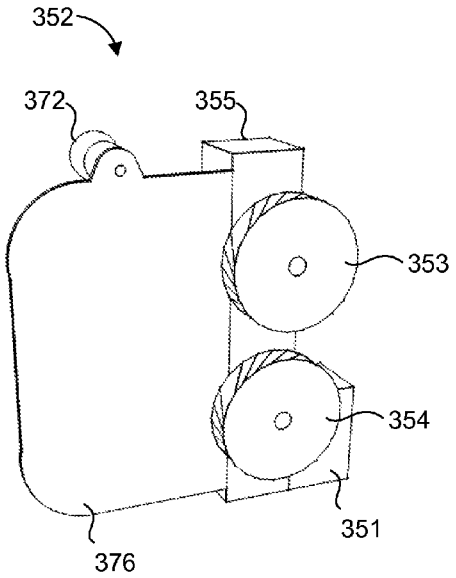
FIG. 4B is an opposite side view of the first pulley member of FIG. 4A.

With reference to FIGS. 4A and 4B, illustrated is a first pulley member 352, in accordance with an example of the present disclosure. The first pulley member 352 can include a guide or track engagement feature 355 configured to allow the first pulley member 352 to move along a track. The track engagement feature can include a square channel, round channel, T-channel, hollow shaft, or other configuration that mates with or accommodates a track for relative movement. In one aspect, the track engagement feature 355 can also serve as a mounting location for one or more pulleys 353, 354 of the first pulley member 352.

FIGS. 4A and 4B also illustrate removable coupling features 370, 372. Removable coupling feature 370 is associated with the track engagement feature and comprises a pin to interface with a hole or opening in the track, thus providing a reversibly fixed attribute to the pulley system. Removable coupling feature 372 is associated with cover 376 and comprises a pin to interface with a hole or opening of a second pulley member 356 (see engagement feature 374 in FIGS. 5A and 5B). The cover 376 can be configured to overlap one or more pulleys of a second pulley member 356 when the first pulley member 352 is coupled to the second pulley member 356 when the first and second pulley members 352, 356 are coupled to one another. This can provide a guard or shield for the pulleys of the second pulley member 356. In another aspect, the cable can be coupled to the first pulley member 352 at anchor location 351.

Figure 5A:
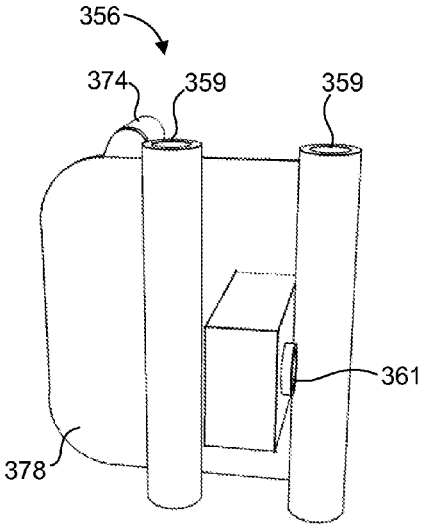
FIG. 5A is a side view of a second pulley member of a pulley system of an exercise device in, accordance with an example of the present disclosure.
Figure 5B:
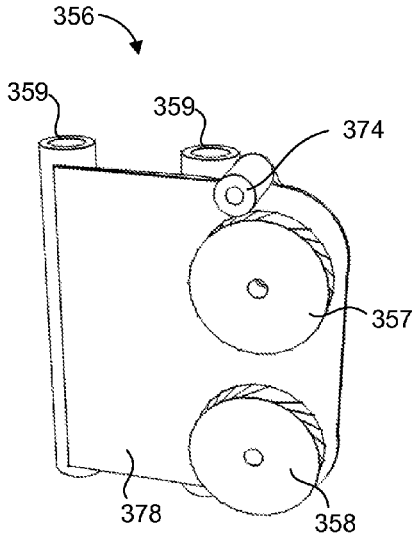
FIG. 5B is an opposite side view of the second pulley member of FIG. 5A

With reference to FIGS. 5A and 5B, illustrated is a second pulley member 356, in accordance with an example of the present disclosure. The second pulley member 356 can include one or more pulleys 357, 358. The second pulley member 356 can also include one or more guide or track engagement features 359 configured to allow the second pulley member 356 to move along the track. The track engagement feature can include a square channel, round channel, T-channel, hollow shaft, or other configuration that mates with or accommodates a track for relative movement. As mentioned above, removable coupling feature 372 of the first pulley member 352 can engage with engagement feature 374 of the second pulley member 356. Cover 378 can support the pulleys 357, 358, track engagement features 359, and engagement feature 374. The cover 378 can also be configured to overlap one or more pulleys of a first pulley member 352 when the first pulley member is coupled to the second pulley member 356. This can provide a guard or shield for the pulleys of the first pulley member 352 when the first and second pulley members 352, 356 are coupled to one another.

Additionally, the second pulley member 356 can include a coupling 361 for a handle. In one aspect, the handle is removable from the second pulley member 356 and the coupling 361 enables removable attachment of the handle to the second pulley member. For example, the coupling 361 can provide a hole or shaft configured to receive the handle therein. In one aspect, the handle slides into the hole or shaft. In another aspect, the handle is threaded into the hole or shaft. The coupling 361 for the handle can also be supported by the cover 378. The coupling 361 can also include a biasing mechanism, such as a spring, operable with a safety mechanism, as discussed below.

Figure 6:
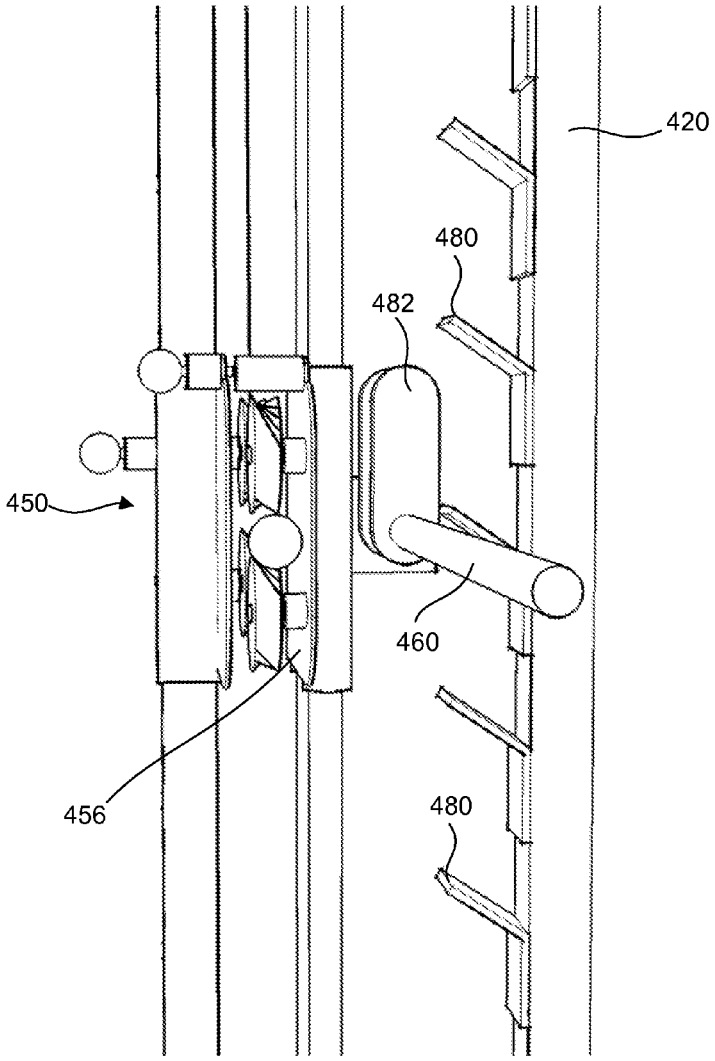
FIG. 6 is a side view of a pulley system with a safety mechanism, in accordance with an example of the present disclosure.
Figure 7:
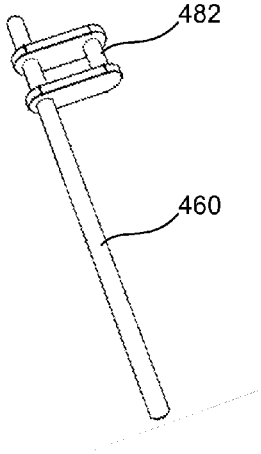

With reference to FIGS. 6 and 7, the exercise device can further comprise a safety mechanism to help prevent injury to a user during an exercise. The safety mechanism can provide a hook 480 and a catch 482 to secure the entire pulley system 450 or the second pulley member 456, preventing downward movement of the pulley system 450 or second pulley member 456 that may cause harm to the user. In a particular embodiment, the safety mechanism can include the hook 480 supported by the frame 420 and the catch 482 supported by the handle 460. Alternatively, the safety mechanism can include a catch supported by the frame and a hook supported by the handle. In either case, the hook can engage the catch to prevent movement of the pulley system 450 or second pulley member 456 in a given direction or directions. In a particular aspect, the handle 460 can be biased, such as by a spring, to engage the catch and the hook. To proceed with an exercise, the user can rotate the handle 460, freeing the catch from the hook. When finished with the exercise, the user can manually rotate the catch and hook into engagement or the user can rely on the self-biasing of the catch with the spring to secure the pulley system.

In one aspect, the safety mechanism can be employed when setting up a bench press type exercise or a pull down type exercise. In this case, the second pulley member is disengaged from the first pulley member. The user can engage the catch and hook to secure the second pulley member at a suitable location relative to the frame, such as a location for beginning the exercise.

In a related example, and to reiterate to some degree, a method of using an exercise device is presented in accordance with the principles herein. The method comprises fixing a first pulley member of a pulley system to a frame of an exercise device, the pulley system being movably coupled to the frame along a track and configured to be reversibly fixed relative to the frame. The method also comprises moving a second pulley member of the pulley system relative to the first pulley member, the second pulley member being removably attachable to the first pulley member, wherein a cable coupled to a resistance component is supported by the frame and the first pulley member, and a motion end of the cable is fixed relative to the second pulley member. It is noted that no specific order is required in this method, though generally in one embodiment, these method steps can be carried out sequentially.

In one aspect, the method further comprises attaching a handle to the second pulley member. In another aspect, the method further comprises attaching the second pulley member to the first pulley member and moving the motion end of the cable relative to the second pulley member, wherein the cable is supported by the second pulley member. In a particular aspect, the method further comprises attaching a handle to the motion end of the cable. In yet another particular aspect, the method further comprises detaching the second pulley member from the first pulley member.

It is to be understood that the above-referenced embodiments are illustrative of the application for the principles of the present invention. Numerous modifications and alternative arrangements can be devised without departing from the spirit and scope of the present invention while the present invention has been shown in the drawings and described above in connection with the exemplary embodiment(s) of the invention. It will be apparent to those of ordinary skill in the art that numerous modifications can be made without departing from the principles and concepts of the invention as set forth in the claims.

What is claimed is:

1. An exercise device, comprising:

a frame;

a resistance component coupled to the frame;

a cable coupled to the resistance component and supported by the frame, configured to transmit a force from a motion end of the cable to the resistance component; and a pulley system movably coupled to the frame along a track, said pulley system supporting the cable as the cable transmits the force to the resistance component, said pulley system configured to be reversibly fixed in position relative to the frame, wherein the pulley system includes a first pulley member and a second pulley member, the second pulley member being removably attachable to the first pulley member such that at least one of the first and second pulley members can be independently moved along the track.

2. The exercise device of claim 1, wherein the first pulley member comprises a plurality of pulleys.

3. The exercise device of claim 1, wherein the second pulley member comprises a plurality of pulleys.

4. The exercise device of claim 1, wherein the second pulley member is removably attachable to the first pulley member by a pin connection.

5. The exercise device of claim 1, wherein the pulley system is reversibly fixed to the frame by a connection between the first pulley member and the frame.

6. The exercise device of claim 5, wherein the connection between the first pulley member and the frame is a pin connection.

7. The exercise device of claim 1, further comprising a handle removably attached to the motion end of the cable to facilitate an exercise, wherein the pulley system is fixed relative to the frame and the motion end of the cable is coupled to the second pulley member such that the motion end is movable relative to the second pulley member.

8. The exercise device of claim 7, wherein the pulley system is fixed relative to the frame via the first pulley member being fixed relative to the frame and the second pulley member is removably attached to the first pulley member.

9. The exercise device of claim 1, further comprising a handle attached to the second pulley member to facilitate an exercise, wherein the first pulley member is fixed relative to the frame, the second pulley member is movable relative to the first pulley member, and the motion end of the cable is coupled to the second pulley member such that the motion end is fixed relative to the second pulley member.

10. The exercise device of claim 9, wherein the handle is removably attached to the second pulley member.

11. The exercise device of claim 9, further comprising a safety mechanism including a catch supported by the frame and a hook supported by the handle.

* * * * *